US008449667B2

(12) United States Patent
Lu et al.

(10) Patent No.: US 8,449,667 B2
(45) Date of Patent: May 28, 2013

(54) SEALING REAGENT FOR ALUMINUM ALLOY

(75) Inventors: Ping Lu, Shenzhen (CN); Chunnan Gao, Shenzhen (CN); Xiaolu Cui, Shenzhen (CN)

(73) Assignee: BYD Co. Ltd., Shenzhen (CN)

( * ) Notice: Subject to any disclaimer, the term of this patent is extended or adjusted under 35 U.S.C. 154(b) by 689 days.

(21) Appl. No.: 12/603,925

(22) Filed: Oct. 22, 2009

(65) Prior Publication Data

US 2010/0129560 A1 May 27, 2010

(30) Foreign Application Priority Data

Nov. 27, 2008 (CN) ..... 2008 1 0217696

(51) Int. Cl.
*C25D 11/24* (2006.01)

(52) U.S. Cl.
CPC ..... *C25D 11/246* (2013.01)
USPC ..... 106/287.14; 106/287.23; 106/287.24; 427/419.8; 427/435; 205/204

(58) Field of Classification Search
CPC ..... C25D 11/246
USPC ..... 106/287.14, 287.23, 287.24; 427/419.8, 427/435; 205/204
See application file for complete search history.

(56) References Cited

U.S. PATENT DOCUMENTS 3,647,649 A * 3/1972 Treiber ..... 205/50
4,521,463 A * 6/1985 Powers et al. ..... 427/435
5,374,455 A * 12/1994 Patel et al. ..... 427/435
5,411,607 A * 5/1995 Basaly et al. ..... 148/272

FOREIGN PATENT DOCUMENTS

EP 0122129 A2 * 10/1984

OTHER PUBLICATIONS

"Surfactants Compliance Directive Oct. 2011", (Oct. 2011).*

* cited by examiner

*Primary Examiner* — David M Brunsman
(74) *Attorney, Agent, or Firm* — Brinks Hofer Gilson & Lione

(57) ABSTRACT

A nickel-free sealing reagent comprises an alkyl sodium sulfonate compound, a dispersing agent, and a siloxane defoaming agent. A method of sealing an alloy comprises applying a nickel-free sealing reagent to the alloy, wherein the sealing agent comprises an alkyl sodium sulfonate compound, a dispersing agent, and a siloxane defoaming agent.

12 Claims, No Drawings

SEALING REAGENT FOR ALUMINUM ALLOY

CROSS REFERENCE TO RELATED APPLICATION

This application claims priority to Chinese Patent Application No. 200810217696.8, filed Nov. 27, 2008, the entirety of which is hereby incorporated by reference.

FIELD

The present invention relates to sealing technology of aluminum alloy, and more particularly to a nickel-free sealing reagent for aluminum alloy anodizing.

BACKGROUND

At present, moderate- or low-temperature sealing reagents are widely used to reduce the porosity and adsorption capacity of anodic oxide films in the processing after aluminum alloy anodizing. Such reagents are convenient to use, and many of them contain nickel ions. Because of nickel allergy caused by frequent contact of nickel containing metal ornamentals with human body, there are standards in many countries that limit the use of nickel-containing ornamentals, such as BS EN 1811:1999 and BS EN 12472:2005. Therefore, nickel-free sealing reagents for aluminum alloy anodizing are urgently needed.

In prior art, a relatively mature nickel-free sealing reagent is fluotitanate moderate temperature sealing reagents. For example, a sealing reagent includes 5-10 g/L potassium fluotitanate, 0.05-0.15 g/L cyclohexanone and 0.05-0.15 g/L isoamyl alcohol. It is used at the temperature of 55-65° C., and the treatment time is 1.0-1.5 μm/min. This sealing reagent is nickel-free, but some dyed workpieces lose weight significantly after processing by this sealing reagent.

SUMMARY

In one aspect, a nickel-free sealing reagent comprises an alkyl sodium sulfonate compound, a dispersing agent, and a siloxane defoaming agent.

In another aspect, a method of sealing an alloy comprises applying a nickel-free sealing reagent to the alloy, wherein the sealing agent comprises an alkyl sodium sulfonate compound, a dispersing agent, and a siloxane defoaming agent.

DETAILED DESCRIPTION

It will be appreciated by those of ordinary skill in the art that the embodiments disclosed herein can be embodied in other specific forms without departing from the spirit or essential character thereof. The presently disclosed embodiments are therefore considered in all respects to be illustrative and not restrictive.

According to one embodiment, a sealing reagent for aluminum alloy comprises an alkyl sodium sulfonate compound, a dispersing agent, a siloxane defoaming agent, a buffering agent, and water.

The alkyl sodium sulfonate compound is a nickel-free salt of the sealing reagent. The term "nickel-free" means substantially free of nickel or nickel-containing compounds. In some embodiments, the alkyl sodium sulfonate compound comprises one or more of sodium dodecyl sulfonate, sodium dodecyl benzene sulfonate, sodium cetyl sulfonate, and sodium cetyl benzene sulfonate.

The dispersing agent can be any dispersing agent known by one skilled in the art. In some embodiments, the dispersing agent comprises one or more of sodium naphthylmethylene sulfonate, methylene di(sodium benzyl naphthalene sulfonate) (dispersing agent CNF), and methyl naphthalene-sulfonate/formaldehyde condensation polymer.

The defoaming agent can reduce the large amount of foam formed when the sealing reagent is stirred. Siloxane defoaming agents are used in some embodiments. The siloxane defoaming agent comprises one or more of poly(dimethylsiloxane), polyether modified polysiloxane, ethoxyl modified trisiloxane, and siloxane-oxyalkylene copolymers.

One effect of the defoaming agent is replacing any foam stabilizer on the liquid-air interface. So the defoaming agent must have a higher surface activity than the foam stabilizer, be able to enter the foam and spread spontaneously, and then repulse the stabilizer and stop the self-repairing of the liquid membrane. High surface viscosity could stabilize the foam, so the defoaming agent must have a low surface viscosity. The siloxane defoaming agent is a preferred defoaming agent because Si—O chain is a non-polar highly hydrophobic molecule. Siloxane has a lower surface energy than carbon chain hydrocarbons, as well as a lower surface tension than common surfactants. At the same time, it has a very low surface viscosity, and the influences of its chemical inertia on environment and human are very little too.

The buffering agent has the function of stabilizing the pH of the sealing system for a long period of time. In some embodiments, the buffering agent comprises one or more of sodium acetate, disodium hydrogen phosphate, sodium dihydrogen phosphate, and sodium citrate.

According to one embodiment, the alkyl sodium sulfonate compound is about 3 weight percent to about 10 weight percent of the sealing reagent. The dispersing agent is about 1 weight percent to about 2 weight percent of the sealing reagent. The siloxane defoaming agent is about 1 weight percent to about 2 weight percent of the sealing reagent. The buffering agent is about 1 weight percent to about 5 weight percent of the sealing reagent.

In some embodiments, the pH value of the sealing reagent for aluminum alloy is not limited to any specific value. Preferably, the sealing reagent may have pH values of from about 5 to about 6.5.

The sealing reagent of the present disclosure can be used for sealing processes after anodizing for various aluminum alloys. The aluminum alloys can be any of Series 1xxx to 7xxx aluminum alloys or superhard aluminum alloys. Series 1xxx aluminum alloys are high purity aluminum (> about 99.99 wt %); Series 2xxx aluminum alloys contain main alloy element Cu, and other elements such as Mn, Mg, Pb and Bi; Series 3xxx aluminum alloys contain main alloy element Mn; Series 4xxx aluminum alloys contain main alloy element Si; Series 5xxx aluminum alloys contain main alloy element Mg; Series 6xxx aluminum alloys contain main alloy element Mg and Si; Series 7xxx aluminum alloys contain main alloy element Zn, and other elements such as Mg and Cu. The hardness of the superhard aluminum alloys, which contain main alloy element Zn, Pb, Mg and Cu, is similar to that of steel. The alloys above may further contain a small amount other elements such as Ni and Fe.

The technology of aluminum alloy anodizing can be any technology known by one skilled in the art. In some embodiments, the process of aluminum alloy anodizing includes the steps of: taking the aluminum alloy into an electrolytic bath within about 180-220 g/L sulfuric acid solution; anodizing for about 30-50 minutes using the aluminum alloy as an anode, wherein the anodizing condition includes the voltage of about 12-18 V, the current density of about 1-2 A/dm$^2$, and the temperature of about 19-22° C.; removing and cleaning the alloy when the anodizing is completed.

The aluminum alloy further can be pre-treated before anodizing. The pretreatment may include the steps of: placing the aluminum alloy into a 30-40 g/L degreasing solution at about 50-60° C. for about 3-5 minutes; removing the grease on the alloy surface to obtain a substantially oil-free substrate; placing the substrate into a mixed acid solution of about 500-700 g/L phosphoric acid and about 150-200 g/L sulphuric acid for chemical polishing for about 3-10 seconds, and then immediately transferring the substrate into water to wash out the acid on the substrate surface; placing the substrate into a 10-40 g/L sodium hydroxide solution for about 1-3 minutes, and then immediately transferring the substrate into water to wash out the alkali on the substrate surface.

The following are various embodiments of nickel-free reagent in sealing process according to the present disclosure.

EXAMPLE 1

(1) Anodizing of 1050 Aluminum Alloy

A 1050 aluminum alloy as a substrate is placed into a 35 g/L degreasing solution at about 60° C. for about 5 minutes, and then the grease on the alloy surface is washed out. The substrate is placed into a mixed acid solution of about 600 g/L phosphoric acid and about 200 g/L sulphuric acid for chemical polishing for about 10 seconds, and then the substrate is immediately transferred into water to wash out the acid on the substrate surface. The substrate is placed into a 30 g/L sodium hydroxide solution for about 3 minutes, and then it is immediately transferred into water to wash out the alkali on the substrate surface.

The aluminum alloy substrate above is placed into an electrolytic bath with—a 220 g/L sulfuric acid solution, and it is anodized as an anode for about 50 minutes. The anodizing condition includes the voltage of about 18 V, the current density of about 2 A/dm$^2$, and the temperature of about 20° C.

The alloy substrate is taken out from the solution and cleaned when the anodizing is completed.

(2) Preparation of the Sealing Reagent

About 60 g sodium dodecyl sulfonate, 15 g sodium naphthylmethylene sulfonate, 15 g siloxane, 30 g sodium acetate and an appropriate amount of deionized water are added and mixed to obtain about 1000 g sealing reagent.

(3) Sealing

The aluminum alloy treated in step (1) is placed into the sealing reagent of step (2) with an initial concentration of about 0.7 ml/L at about 85° C. for about 15 minutes, and then it is dried in baking oven at about 60° C. for about 15 minutes.

EXAMPLE 2

(1) Anodizing of 5056 Aluminum Alloy

A 5056 aluminum alloy is used as a substrate to anodize. The steps are similar to those used in step (1) of Example 1, with the difference being the dyeing process after anodizing: the substrate is placed into a dyeing solution for about 2-15 minutes. The concentration of the dyeing solution is about 1-10 g/L; the pH is about 6; the dosage is about 6 g per 1 m$^2$ substrate; and the temperature of the dyeing solution is about 50° C. And then the substrate is taken out from the dyeing solution and cleaned after dyeing.

(2) Preparation of the Sealing Reagent

About 30 g sodium dodecyl sulfonate, 10 g dispersing agent CNF, 20 g siloxane, 50 g sodium citrate and an appropriate amount of deionized water is added and mixed to obtain about 1000 g sealing reagent.

(3) Sealing

The aluminum alloy treated in step (1) is placed into the sealing reagent of step (2) with an initial concentration of about 1.5 ml/L at about 87° C. for about 20 minutes, and then it is dried in baking oven at about 60° C. for about 15 minutes.

EXAMPLE 3

(1) Anodizing of 7003 Aluminum Alloy

A 7003 aluminum alloy is used as a substrate to anodize. The steps are similar to those used in step (1) of Example 2.

(2) Preparation of the Sealing Reagent

About 100 g sodium cetyl benzene sulfonate, 20 g methyl naphthalenesulfonate/formaldehyde condensation polymer, 10 g siloxane, 10 g sodium dihydrogen phosphate and an appropriate amount of deionized water are added and mixed to obtain about 1000 g sealing reagent.

(3) Sealing

The aluminum alloy treated in step (1) is placed into the sealing reagent of step (2) with an initial concentration of about 4 ml/L at about 91° C. for about 30 minutes, and then it is dried in baking oven at about 60° C. for about 15 minutes.

EXAMPLE 4

(1) Anodizing of 6061 Aluminum Alloy

A 6061 aluminum alloy is used as a substrate to anodize. The steps are similar to those used in step (1) of Example 2.

(2) Preparation of the Sealing Reagent

About 50 g sodium cetyl benzene sulfonate, 18 g methyl naphthalenesulfonare/formaldehyde condensation polymer, 12 g siloxane, 16 g disodium hydrogen phosphate and an appropriate amount of deionized water are added and mixed to obtain about 1000 g sealing reagent.

(3) Sealing

The aluminum alloy treated in step (1) is placed into the sealing reagent of step (2) with an initial concentration of about 8 ml/L at about 95° C. for about 40 minutes, and then it is dried in baking oven at about 60° C. for about 15 minutes.

Reference 1

(1) Anodizing of 6061 Aluminum Alloy

A 6061 aluminum alloy is used as a substrate to anodize. The steps are similar to those used in step (1) of Example 1.

(2) Sealing

The aluminum alloy treated in step (1) is placed into a sealing reagent (TOP DX-500, with the main ingredient of nickel acetate, from OKUNO New Technology Industries (Hangzhou) Co. Ltd, China) with a concentration of about 7 g/L at about 90° C. for about 20 minutes, and then it is dried in baking oven at about 60° C. for about 15 minutes.

Testing (1) Nickel Content, Nickel Releasing, Corrosion Resistance and Wear Resistance According to the test method in BS EN12472: 2005, the nickel content and nickel releasing of EXAMPLE 4 and REFERENCE 1 are shown in Table 1. And according to the standards of IS09227-1990 and ASTM F2357-04 to test the salt mist corrosion and wear resistance of EXAMPLE 4 and REFERENCE 1, the results are shown in Table 1 too.

TABLE 1

Nickel Content, Nickel Releasing, Corrosion Resistance and Wear Resistance of EXAMPLE 4 and REFERENCE 1

| | Nickel Content (ppm) | Nickel Releasing ($\mu g/cm^2$/week) | Corrosion Resistance (h) | Wear Resistance (cycle) |
|---|---|---|---|---|
| 6061 Aluminum Alloy | 85 | <0.1 | / | / |
| EXAMPLE 4 | 86 | <0.1 | 2320 | 1050 |
| REFERENCE 1 | 540 | 1.4 | 2400 | 1020 |

From Table 1, it can be observed that the 6061 aluminum alloy treated by the nickel-free sealing reagent of EXAMPLE 4 contains substantially no more nickel than the substrate itself does before being treated by the nickel-free sealing reagent. In contrast, the 6061 aluminum alloy treated by the nickel-containing sealing reagent of Reference 1 contains substantially more nickel than the substrate itself does before being treated by the nickel-containing sealing reagent. The reliability performances of the 6061 aluminum alloy treated by the nickel-free sealing reagent are similar to the 6061 aluminum alloy treated by the nickel-containing sealing reagent.

(2) Weight Loss

The sealing effect can be assessed in a weight loss test. Following the standards of GB/T5237.2-2000a spot on the surface of samples is wiped clean. A proper organic solution is used to degrease the samples at room temperature. After drying and weighing, the samples are placed into a (38±1)° C. mixture of phosphoric acid and chromic acid for about 15 minutes. The samples are weighed again after washing and drying. Then the weight loss is calculated. The weight losses of EXAMPLE 1-4 and REFERENCE 1 are shown in Table 2.

TABLE 2

Weight Loss of EXAMPLE 1-4 And REFERENCE 1

| | Weight Loss ($mg/dm^2$) |
|---|---|
| Example 1 | 1.5 |
| Example 2 | 2.4 |
| Example 3 | 5.1 |
| Example 4 | 6.5 |
| Reference 1 | 3.2 |

The sealing is qualified if the weight loss is less than about 20 $mg/dm^2$. From Table 2, it can be observed that all the sealing reagents are qualified. Especially, the weight losses of aluminum alloys in EXAMPLE 1-4 are less than about 7.0 $mg/dm^2$.

Although the present disclosure has been described in detail with reference to several embodiments, additional variations and modifications exist within the scope and spirit as described and defined in the following claims.

What is claimed is:

1. A nickel-free sealing reagent, comprising:

a sodium sulfonate compound selected from the group consisting of an alkyl sodium sulfonate and an alkyl phenyl sodium sulfonate;

a dispersing agent; and a siloxane defoaming agent.

2. A nickel-free sealing reagent, comprising:

a sodium sulfonate compound, wherein the sodium sulfonate compound comprises one or more compounds selected from the group consisting of sodium dodecyl sulfonate, sodium dodecyl benzene sulfonate, sodium cetyl sulfonate, and sodium cetyl benzene sulfonate;

a dispersing agent; and a siloxane defoaming agent.

3. The nickel-free sealing reagent of claim 2, wherein the dispersing agent comprises one or more compounds selected from the group consisting of sodium naphthylmethylene sulfonate, methylene di(sodium benzyl naphthalene sulfonate), and methyl naphthalenesulfonate/formaldehyde condensation polymer.

4. The nickel-free sealing reagent of claim 2, wherein the siloxane defoaming agent comprises one or more compounds selected from the group consisting of poly(dimethylsiloxane), polyether modified polysiloxane, ethoxyl modified trisiloxane, and siloxane-oxyalkylene copolymers.

5. The nickel-free sealing reagent of claim 2, further comprising a buffering agent.

6. The nickel-free sealing reagent of claim 5, wherein the buffering agent comprises one or more compounds selected from the group consisting of sodium acetate, disodium hydrogen phosphate, sodium dihydrogen phosphate, and sodium citrate.

7. The nickel-free sealing reagent of claim 5, wherein the buffering agent is about 1 weight percent to about 5 weight percent of the sealing reagent.

8. The nickel-free sealing reagent of claim 2, wherein the sodium sulfonate compound is about 3 weight percent to about 10 weight percent of the sealing reagent.

9. The nickel-free sealing reagent of claim 2, wherein the dispersing agent is about 1 weight percent to about 2 weight percent of the sealing reagent.

10. The nickel-free sealing reagent of claim 2, wherein the siloxane defoaming agent is about 1 weight percent to about 2 weight percent of the sealing reagent.

11. The nickel-free sealing reagent of claim 2, which has a pH value of from about 5 to about 6.5.

12. The nickel-free sealing reagent of claim 2, which is an aqueous solution.

* * * * *